United States Patent [19]

von Hagen

[11] Patent Number: 4,526,119

[45] Date of Patent: Jul. 2, 1985

[54] SEWING MACHINE HAVING A DRIVEN FEED ROLLER

[75] Inventor: Wolf R. von Hagen, Hemmingen, Fed. Rep. of Germany

[73] Assignee: Union Special G.m.b.H., Stuttgart, Fed. Rep. of Germany

[21] Appl. No.: 551,787

[22] Filed: Nov. 14, 1983

[30] Foreign Application Priority Data

Nov. 20, 1982 [DE] Fed. Rep. of Germany ..... 3242937

[51] Int. Cl.[3] ..... D05B 27/10

[52] U.S. Cl. ..... 112/322; 112/320; 226/156

[58] Field of Search ..... 112/320, 322, 318; 403/73, 74, 57, 58; 118/305; 226/156, 157, 152

[56] References Cited

U.S. PATENT DOCUMENTS

| | | | |
|---|---|---|---|
| 1,129,404 | 2/1915 | Kelso . | |
| 1,487,420 | 3/1924 | Witkus . | |
| 1,487,421 | 3/1924 | Witkus . | |
| 2,177,854 | 10/1939 | Antonelli . | |
| 2,600,597 | 6/1952 | Winberg | 112/322 X |
| 3,170,426 | 2/1965 | Micale . | |
| 3,933,106 | 1/1976 | Murray . | |
| 3,994,248 | 11/1976 | Marforio | 112/322 |
| 4,305,344 | 12/1981 | Baskett | 118/305 |
| 4,462,530 | 7/1984 | Block et al. | 112/320 X |

FOREIGN PATENT DOCUMENTS

| | | | |
|---|---|---|---|
| 581187 | 1/1932 | Fed. Rep. of Germany | 112/214 |

*Primary Examiner*—Werner H. Schroeder
*Assistant Examiner*—Andrew M. Falik
*Attorney, Agent, or Firm*—John W. Harbst; John A. Schaerli

[57] ABSTRACT

A sewing machine presser foot attachment including a driven feed wheel proximately arranged relative to the reciprocal path of a needle. The feed wheel is powered by a drive shaft arranged to the rear of the feed wheel in the direction of sewing. A constant velocity universal joint arranged between the drive shaft and feed wheel permits vertical and horizontal pivotal movement of the feed wheel relative to the work supporting surface of the machine.

11 Claims, 4 Drawing Figures

SEWING MACHINE HAVING A DRIVEN FEED ROLLER

FIELD OF THE INVENTION

The invention relates, in general, to sewing machines and more particularly, to a presser foot attachment for sewing machines.

BACKGROUND OF THE INVENTION

Sewing machines using wheels as presser mechanisms are well known in the art. Some of such wheels have been driven. An example of such a feed wheel is shown in German Pat. No. 2,220,865 issued to Alphonse De Koninck. The feed wheel in such device is usually disposed closely adjacent the needle and serves to replace the usual presser foot means of the machine. Because of its disposition closely proximate the needle's path, access to the needle is limited. In overedge machines, the feed wheel's disposition relative to the needle is dictated by the presence of a looper which moves into cooperation with and on one side of the needle to form overedge stitches. Understandably, the feed wheel cannot be arranged on the same side of the needle with the loopers. As such, the feed wheel must be arranged on the opposite side of the needle's path. The arrangement shown in the above mentioned German Patent is not so disposed nor considered. The disposition of the wheel as shown in the patented apparatus would not only limit the threading of the needle but also that of the looper.

SUMMARY OF THE INVENTION

In line with the above, and in keeping with the present invention, there is provided a feed wheel mechanism for a sewing machine which satisfies the wants and needs of today's industry. The present invention provides a feed wheel assembly which is positively driven. As such, the wheel assembly, because of its size and driven ability, may climb over seams or heavy material with relative ease. Moreover, the disposition of the wheel in the present invention readily lends itself for use with overedge sewing machines.

The feed wheel mechanism of the present invention includes a rotatably driven feed wheel disposed closely proximate the stitch forming means of the machine. The feed wheel is powered by a drive shaft arranged rearward of the wheel in the direction of feed. Disposed intermediate the drive shaft and the feed wheel is a constant velocity universal joint. Moreover, the wheel is disposed on a presser arm and because of the universal joint is capable of pivotal movement in both horizontal and vertical directions relative to the work support means of the machine. Because the feed wheel is capable of both horizontal and vertical motion, easy access to the sewing area and instrumentalities is assured.

In accordance with the above, primary object of this invention is the provision of a presser foot attachment including a positively driven feed wheel which is both horizontally and vertically pivotable relative to the work supporting surface of the machine.

Still another object of this invention is to provide an improved presser foot type sewing machine attachment which is durable, having a minimum of part wear, and that requires little or no maintenance.

BRIEF DESCRIPTION OF THE DRAWINGS

Having in mind the above objects and other attendent advantages that would be evident from an understanding of the disclosure, the invention comprises the devices, combinations and arrangement of parts as illustrated in the presently preferred form of the invention which is hereinafter set forth in detail to enable those skilled in the art to readily understand the function, operation, construction and advantages of same when read in conjunction with the accompanying drawings in which.

DETAILED DESCRIPTION OF THE PRESENT INVENTION

Figure 1:
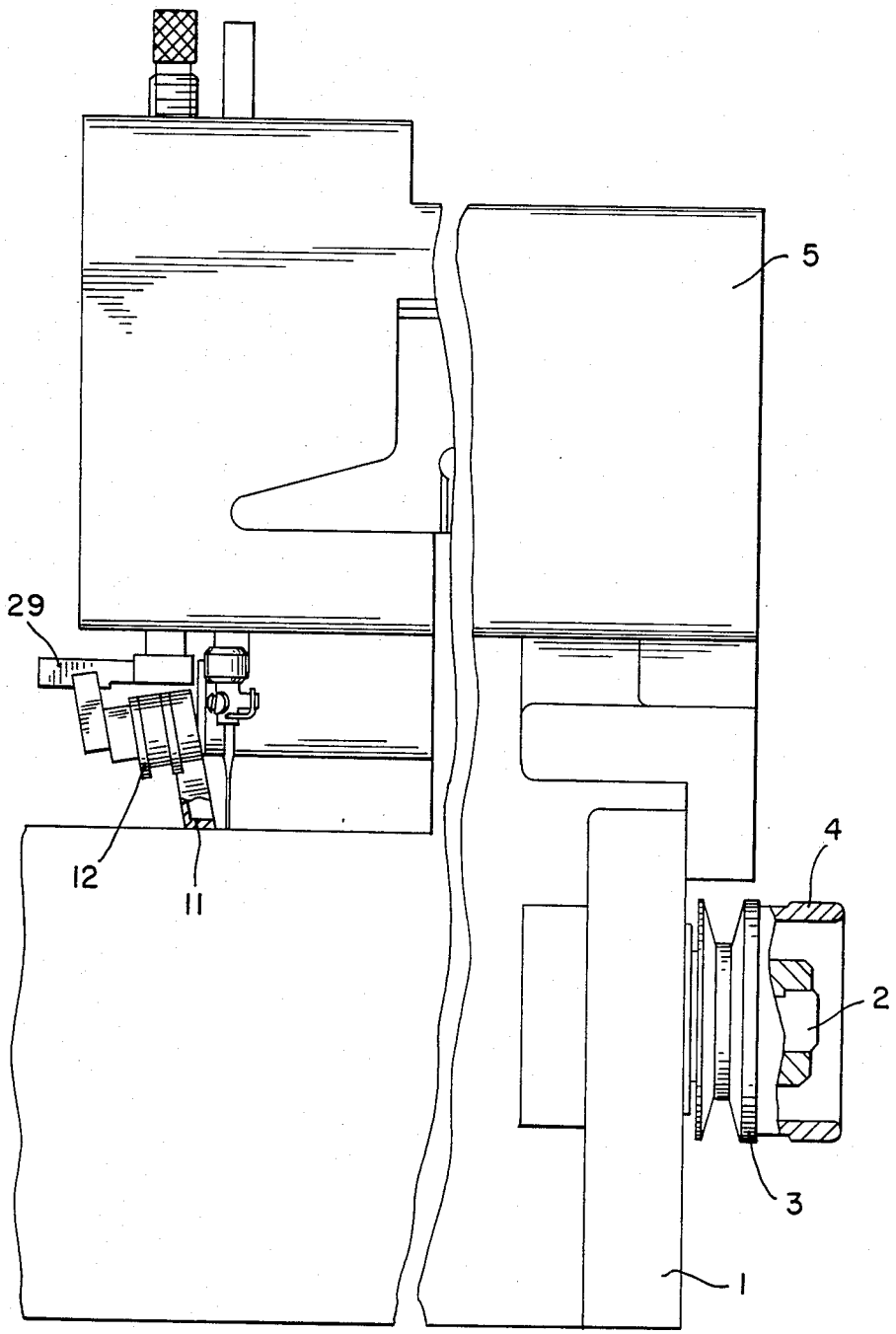
FIG. 1 is a partial front elevational view of a machine incorporating the present invention.
Figure 2:
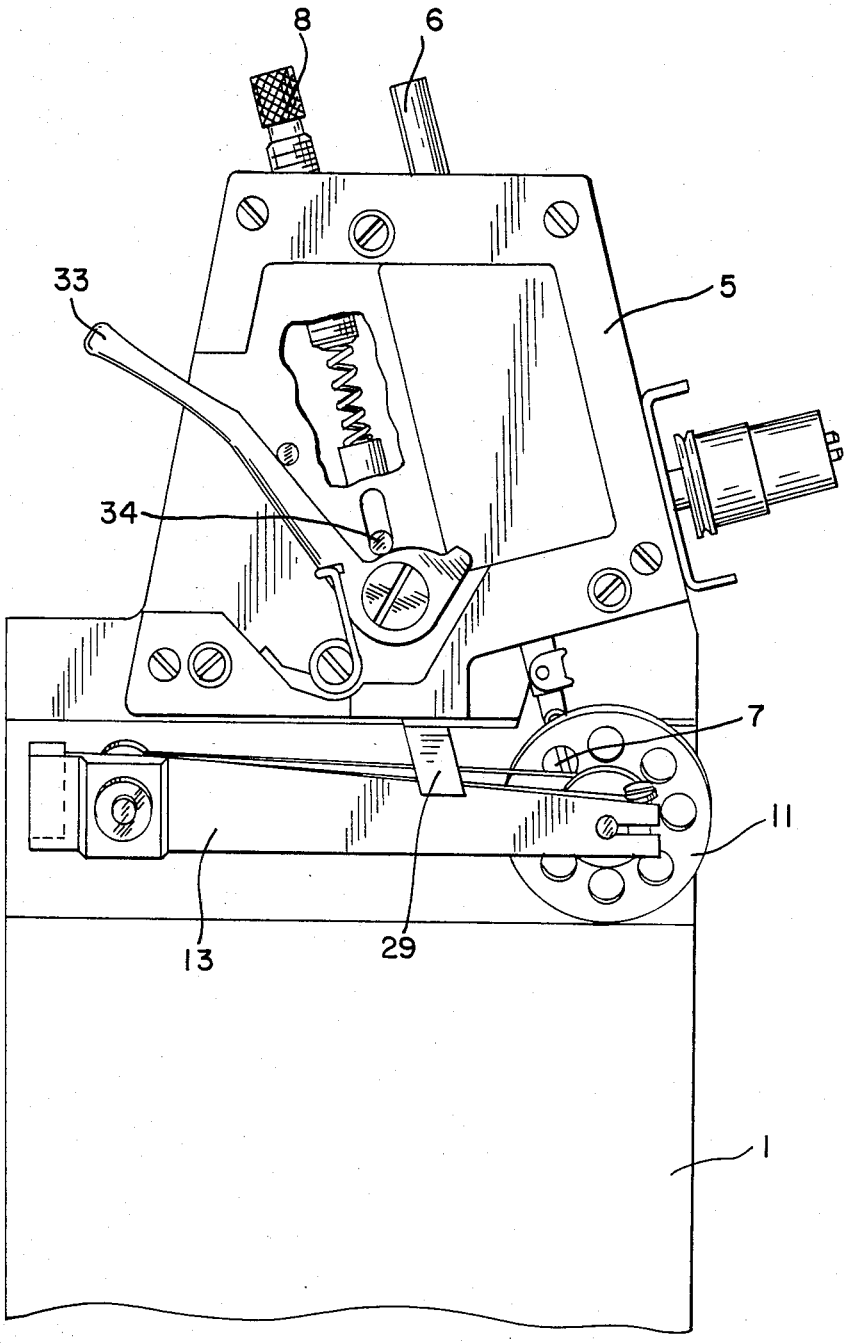
FIG. 2 is a side elevational view of the machine shown in FIG. 1.
Figure 3:
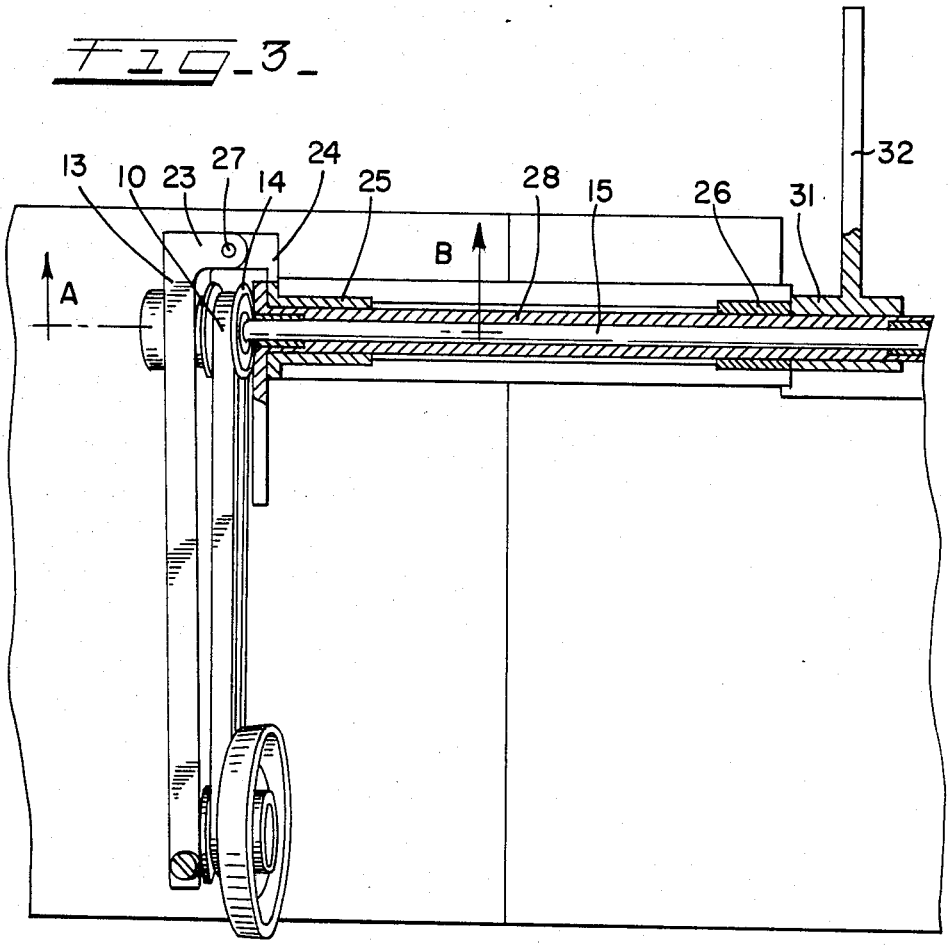
FIG. 3 is a top plan view of the present invention as mounted on a sewing machine.
Figure 4:
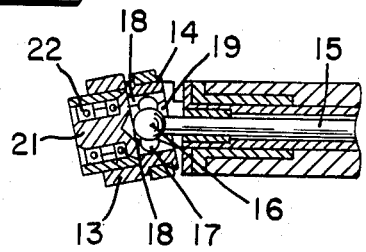
FIG. 4 is a sectional view taken along line 4—4 of FIG. 3.

Referring now in detail to the various drawings, wherein like reference numerals indicate like parts throughout the several views, there is shown in FIGS. 1 and 2, an overedge sewing machine. The sewing machine includes a base 1 having a main shaft 2 with a work supporting surface on the top of the base. The upper portion of the machine includes an arm 5 which terminates in a sewing head. A conventional presser bar assembly 8 is mounted in the sewing head. Also mounted in the sewing head, for endwise reciprocation along a generally vertical path, is a needle bar 6. At is distal end, the needle bar is provided with part of the stitch forming instrumentalities including needle means 7 defining a stitch forming area. A drive pulley 3 and hand wheel 4 are secured to the main shaft 1 on one side of the reciprocal path of the needle means.

Also apparent in FIGS. 1 and 2 is a presser device which is the subject of this patent application. A feed wheel assembly is arranged at one extremity of the presser device. The feed wheel assembly includes a feed wheel 11 having a pulley or gear 12 operatively associated therewith. The feed wheel has a circumferential surface for feeding the workpiece on the work supporting surface. Rotation is imparted to the feed wheel by a motion transmission means or belt 10 which engages or entrains the pulley 12. A horizontally disposed presser arm 13 serves to mount the wheel assembly wholly transverse or to the side of but closely proximate the vertical path of the needle means 7. The other end of the belt 10 entrains or engages a drive pulley or gear 14 proximately supported at the other end of the presser arm 13. The pulley 14 is operatively connected to an elongated drive shaft 15 extending generally parallel with the plane of the work supporting surface. The shaft 15 is driven by the main shaft 2 through any conventional means providing for either intermittent or continuous movement of the drive shaft.

Because the feed wheel of the instant invention is adapted for cooperation with an overedge sewing machine, the presser device must include the ability to swing outwardly from the left side or that side of the needle's path opposite the hand wheel as viewed in FIG. 1. To achieve this purpose, a constant velocity universal joint comprising mutually engagable elements is arranged intermediate the drive shaft and the feed wheel to allow for connection/disconnection of these elements from one another. In the preferred embodiment, the universal joint includes a spherical or ball-like element 16 arranged at the driving end of shaft 15; a plurality of pins 17 radially projecting from said spherical element; and a coupling 18 having longitudinal grooves or slots 19 into which the radial pins 17 extend. If so desired, the coupling and drive pulley may be designed as one piece. Preferably, the ends of the pins are spherically shaped. Moreover, the slots or grooves 19 are conically widened or tapered in the direction toward the shaft 15. The universal joint is stabilized by a projection 21 extending from the gear 14 or coupling and journaled for rotation in a bearing or bushing 22 carried by the arm 13.

The presser arm 13 is fashioned on its rear extremity with bifurcated arms 23 between which is captured an extended arm portion 24 of a bushing 25. The arms 23 and bushing 25 are articulately interconnected by a fastener 27. The bushing 25 is supported in the machine housing and is operatively associated with an elongated sleeve or rock shaft 28. The opposite end of sleeve 28 is supported by a bushing or bearing 26 mounted in the machine frame. Within the sleeve 28, the elongated torque transmitting sleeve 15 is revolvably mounted. By such construction, it will be apparent that suitable support means are provided to allow pivotal movement of the feed wheel about two axes extending substantially vertical and horizontal relative to the work supporting surface of the machine. That is, by this construction, the wheel 11 is tiltably supported around or about the axes of the drive shaft 15 and can be swingably moved from its operative position about the axes of the fastener 27.

The means for urging the feed wheel assembly against the work support surface will now be described. As best seen in FIG. 2, the presser bar assembly 8 may be of any conventional form. Suffice it to say, the assembly 8 includes a presser bar adjusting screw which is threadably received in the frame of the machine. The screw is adapted to impinge on a presser spring also supported in the machine frame. A shoe 29, mounted for generally vertical movement, straddles the arm 13 intermediate the ends thereof. The presser spring operatively presses against the head or shoe 29 to apply force on the presser arm 13 thereby urging the wheel assembly toward or against the work supporting surface. When required, the arm 13 and thereby the wheel assembly 11 may be lifted against the action of the presser spring. To accomplish this end, the rock shaft 28 is rotated, and through the action of the bushing 25 and arm 24, the presser arm 13 and wheel assembly may be rotated counterclockwise as viewed in FIG. 2 about its vertical pivot. To effect such rotation of the rock shaft 28, a bushing 31 having a radially extending arm 32 is provided. The free end of arm 32 may be operatively associated with a well known knee lifting device (not shown).

A presser foot lift mechanism may also be provided. In the preferred embodiment, the presser foot lift mechanism includes a presser spring lift lever 33 articutaly mounted to the machine frame and cooperatively arranged in a well known manner with an extension 34 operatively associated with the head 29. When operated, the camming action of lever 33 lifts the head 29 from contact with the presser arm 13 such that the arm may be swingably rotated about the axis of the fastener 27 whereby removing the wheel assembly from its working position. As a result of the arm's rotation, the universal joint is disconnected from the drive shaft means 15. That is, the cross pins 17 shift along the respective grooves 19 and eventually are completely disengaged from the universal joint.

The simple coupling formed between the drive shaft 15 and the pulley 14 also allows the feed wheel to assume an oblique position. That is, the wheel or rotatably member 11 has its periferal surface inclined to its plane of rotation. The peripheral surface of the wheel is shaped as a frustrum of a cone. By such construction, the surface of the roller foot which makes contact with the work supporting surface or the material on the work supporting surface may be disposed closely proximate the reciprocal path of the needle means. To allow for such feed wheel disposition, the pulley 14 and associated coupling 18 are pivotally arranged about the center point of the spherical element 16. In the preferred embodiment, the bifucated arms 23 of the presser arm 13 are so formed as to allow the wheel to achieve such disposition. That is, both legs of the presser arm's bifucated end extend parallel to the angular disposition of the arm 24.

In operation, the feed wheel assembly positively feeds work across the work supporting surface of the machine while the needle means forms stitches in the workpiece. The feed wheel assembly is driven from the drive shaft 15 arranged rearwardly of the feed wheel 11. The mutually engagable components of the constant velocity universal joint or coupling arranged between the drive shaft and the feed wheel permits pivotal movement of the feed wheel about two axes extending substantially vertical and horizontal to the work supporting surface of the machine. This simple coupling and its functional features allow for ease of threading and access to the stitch forming area of the machine.

Thus there has been provided a Presser Foot Attachment For Sewing Machine that fully satisfies the objects, aims and advantages set forth above. While the invention has been described in conjunction with specific embodiments thereof, it is evident that many alternatives, modifications, and variations will be apparent to those skilled in the art in light of the foregoing descriptions. Accordingly, it is intended to embrace all such alternatives, modifications, and variations as fall within the spirit and broad scope of the appended claims.

Thus having adequately described my invention, what I claim is:

1. In a sewing machine having a work supporting surface, reciprocal needle means defining a stitch forming area, an upper feeding device comprising:

work feed means including a workpiece engaging feed wheel positively driven from a horizontally disposed shaft arranged rearward of the stitch forming area in the direction of feed; and supporting means for wholly arranging the feed wheel on one side of a plane bounded by the direction of feed, said support means includes pivotal means located rearward of the stitch forming area in the direction of feed, said pivotal means providing for pivotal movement of said feed wheel about two axes extending substantially vertical and horizontal relative to the work supporting surface of the machine.

2. The invention according to claim 1 wherein said arm is horizontally disposed.

3. In combination with a sewing machine having reciprocal needle means defining a sewing area, an upper feed mechanism capable of pressing a workpiece to be stitched against a work supporting surface and for feeding the workpiece through the sewing area, said upper feed mechanism comprising:

a rotatably and positively driven feed wheel wholly and transversely disposed to one side of a plane bounded by the direction of feed and operatively connected to a shaft arranged rearward of the feed wheel in the direction of feed; and a spring urged support arm having two ends, pivotal means supporting one of said arm at a location arranged rearward of the stitch forming area in the direction of feed to permit pivotal movement of said feed wheel about two axes extending substantially vertical and horizontal relative to the longitudinal axis of said shaft with the feed wheel being arranged at the other end of said arm.

4. An improved upper feed mechanism for a sewing machine having a work supporting surface, stitch forming means including reciprocal needle means, a hand wheel arranged on one side of the reciprocal path of the needle's stitch forming means, said feed mechanism comprising:

work feeding means including a positively driven feed wheel wholly and transversely disposed closely adjacent the stitch forming means on the opposite side of the reciprocal path of the needle means; and operative means for resiliently urging the feed wheel against the work support surface, said operative means including pivotal means disposed rearward of the stitch forming area in the direction of feed permitting vertical and horizontal feed wheel movements about two axes substantially vertical and horizontal relative to the work supporting surface.

5. The invention according to claim 4 wherein said operative means includes a spring biased arm pivotally mounted at one end and carrying said feed wheel at the other end.

6. In a sewing machine having a work supporting surface, reciprocal needle means defining a stitch forming area, an upper feeding device comprising:

work feeding means including a positively driven workpiece engaging feed wheel, a horiztonally disposed shaft arranged rearward of the stitch forming area in the direction of feed, and a constant velocity univeral joint arranged between said shaft and said feed wheel allowing for disconnection of said feed wheel from said shaft; and supporting means for arranging the feed wheel closely proximate the stitch forming area, said support means includes means arranged rearward of the stitch forming area in the direction of feed providing for pivotal movement of said feed wheel about two axes extending substantially vertical and horizontal relative to the work supporting surface of the machine.

7. The invention according to claim 6 wherein said universal joint includes a spherical element arranged at one end of said shaft, said element having a plurality of radial pins projecting therefrom and received into longitudinal grooves provided on a feed wheel drive member.

8. The invention according to claim 7 wherein said longitudinal grooves are conically widened in the direction toward the shaft.

9. In combination with a sewing machine having reciprocal needle means defining a sewing area, an upper feed mechanism for pressing a workpiece against a work supporting surface while feeding the workpiece through the sewing area, said upper feed mechanism comprising:

a rotatably driven feed wheel disposed closely adjacent the reciprocal path of the needle means, a shaft operatively connected to said feed wheel for imparting rotation thereto, said shaft being arranged rearward of the feed wheel in the direction of feed, wherein said feed wheel is operatively connected to said shaft through a disengagable universal joint allowing for disconnection of said feed wheel from said shaft; and a spring urged support arm having two ends, pivotal means supporting one end of said arm at a location disposed rearward of the sewing area in the direction of feed for permitting pivotal movement of said feed wheel about two axes extending substantially vertical and horizontal relative to the longitudinal axis of said shaft with the feed wheel being arranged at the other end of said arm.

10. In combination with a sewing machine having reciprocal needle means defining a sewing area, an upper feed mechanism for pressing a workpiece against a work supporting surface and for feeding the workpiece through the sewing area, said upper feed mechanism comprising:

a rotatably and positively driven feed wheel disposed closely adjacent the reciprocal path of the needle means, a shaft operatively connected to said feed wheel for imparting rotation thereto, said shaft being arranged rearward of the feed wheel in the direction of feed, wherein said feed wheel is operatively connected to said shaft through a disengagable universal joint comprised of a spherical element arranged on one end of said shaft with radially pins projecting therefrom and a member rotatably carried by a support arm having longitudinal grooves into which the radial pins extend; and wherein said support arm is spring urged and has two ends, one end being supported for pivotal movement about two axes extending substantially vertical and horizontal relative to the longitudinal axis of said shaft with the feed wheel being arranged at the other end of said arm.

11. The sewing machine attachment of claim 10 wherein said longitudinal grooves taper outwardly in the direction toward the shaft.

* * * * *